US006241133B1

(12) United States Patent
Morgan et al.

(10) Patent No.: US 6,241,133 B1
(45) Date of Patent: Jun. 5, 2001

(54) SHIP-ON HANGER HAVING SWIVELING CLAMP ASSEMBLIES

(75) Inventors: Donald F. Morgan, Zeeland; Timothy Holwerda, Comstock Park, both of MI (US)

(73) Assignee: Batts, Inc., Zeeland, MI (US)

( * ) Notice: Subject to any disclaimer, the term of this patent is extended or adjusted under 35 U.S.C. 154(b) by 0 days.

(21) Appl. No.: 09/256,869

(22) Filed: Feb. 24, 1999

(51) Int. Cl.[7] ..... A47G 25/48
(52) U.S. Cl. ..... 223/96; 223/91
(58) Field of Search ..... 223/93, 96, 95, 223/85, 91, 90

(56) References Cited

U.S. PATENT DOCUMENTS 2,822,115 * 2/1958 Cavanagh ..... 223/96
5,400,932 * 3/1995 Hollis ..... 223/96
5,915,605 * 6/1999 Blanchard ..... 223/96
5,992,714 * 11/1999 Morgan ..... 223/96
6,019,261 * 2/2000 Morgan et al. ..... 223/96
6,050,461 * 4/2000 Batts et al. ..... 223/96
6,105,836 * 8/2000 Batts et al. ..... 223/96

* cited by examiner

*Primary Examiner*—Bibhu Mohanty
(74) *Attorney, Agent, or Firm*—Amster, Rothstein & Ebenstein

(57) ABSTRACT

An articulatable ship-on garment hanger having shielding means on the hanger body to prevent dislodgement of a garment from the hanger by outwardly directly dislodging forces, said means extending downwardly over the outside edges of the clamps to prevent dislodgement of a garment from a hanger by inwardly directed dislodging forces, the hanger having a pivot bar and the clamps having associated bar receiving structure which allows the clamps to swivel about the pivot bar in response to dislodgement forces imposed on the clamp means to thereby enable the clamp means to remain in gripping engagement with the hung garment under all bumps, shocks and dislodgement forces imposed on the clamp halves.

13 Claims, 3 Drawing Sheets

11
12
13
14
15
16
18
19
20
23
25
32
44
45
46
47
58
75
76
77
78

Fig. 6.
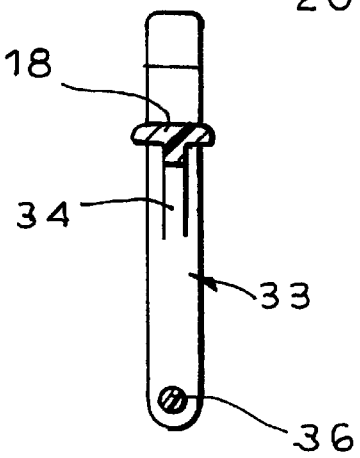
Fig. 10.
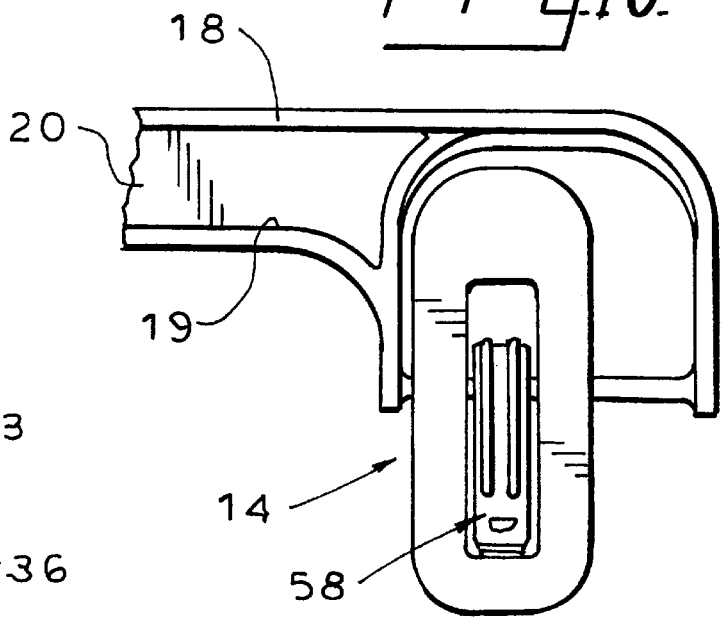
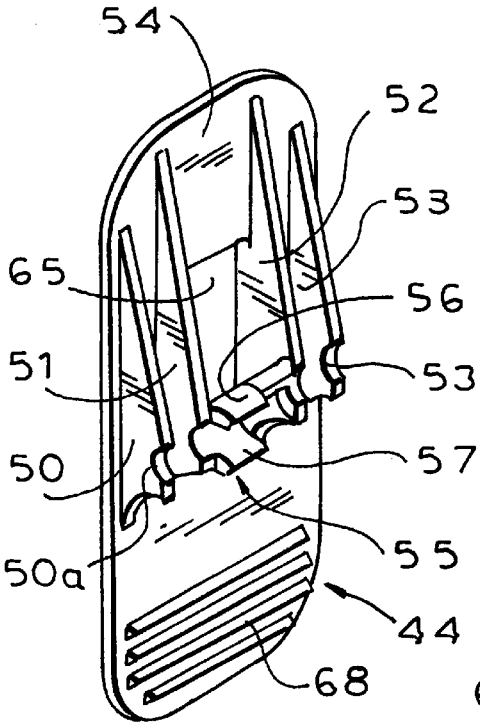
Fig. 7.
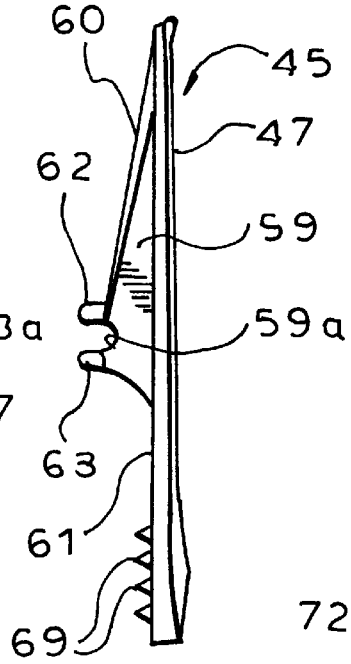
Fig. 8.
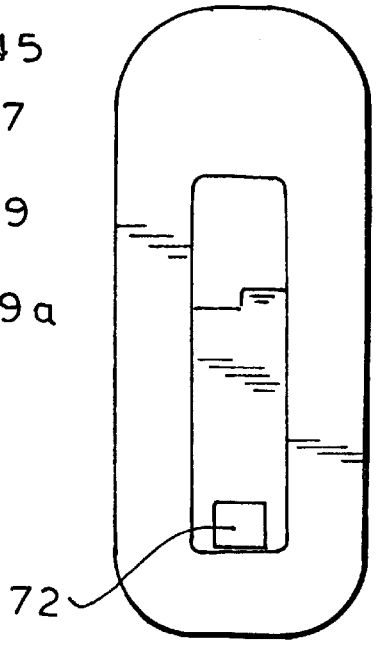
Fig. 9.

SHIP-ON HANGER HAVING SWIVELING CLAMP ASSEMBLIES

This invention pertains generally to garment hangers and more specifically to a garment hanger adapted to be employed as a shipping hanger for garment-on-hanger use, said garment hanger further having means for precluding dislodgement of a garment from its hanger by dislodgement forces encountered during transportation and push/pull forces arising during normal manipulation of garments by customers in retail outlets.

BACKGROUND OF THE INVENTION

A worldwide mode of doing business in the garment industry has evolved in recent years due to economic factors. For example, garments may be very inexpensively manufactured in less developed countries such as Sri Lanka, the garment hanger factory may be located in Taiwan or Hong Kong, and the garments may be destined for sale in the U.S. Thus it is quite common today for garments to be made in one country, the hangers on which the garments are to be displayed made in another country, and the garment displayed for sale in yet a third country.

Inherent in the above mode of doing business is the shipment of garments on hangers from a final garment-to-hanger assembly location—almost invariably a garment manufacturing facility—to an ultimate destination, such as a retail store in the United States. If a garment is manufactured in Taiwan or Hong Kong for example and clipped to a hanger at that location, the hung garment is thereafter subjected, along with many other similar garments on hangers in a shipping container, to the shocks and bumps inherent in international transportation. Thus shipping containers may be assembled at a shipping dock at the garment manufacturing facility preparatory to loading onto a delivery truck for transport to a waterfront or an airport. In just this first step in the multi-step shipping process the garments will be subjected to shocks and bumps from human handling of the loaded containers in the factory and from rough handling as they are trundled to the shipping dock by fork lift truck. As the garments are bumped and jostled some or all of the garments will be struck by an adjacent garment, and if the adjacent garment hits the shock receiving garment in the clip area, one jaw of the clip which is gripping the shock receiving garment may be struck at a location on the clip which causes the clip to open and loosen its garment gripping force, with a consequent dropping of one side of the garment. If, later, the other active clip on the garment-hanger combination is also struck due to handling forces, said other clip may also open with the result that the garment then drops to the floor of the shipping container in a jumbled heap.

Similar opportunities for causing a clip to be jarred open occur many times during the long journey from Asia, for example, to the U.S. as the shipping container receives shocks and bumps every time a physical transfer of the shipping container from one mode of transportation occurs and, also, during a leg in the journey such as when a ship rolls at sea or an airplane is braked during taxi movement or as it reaches an unloading station.

When the garments in a shipping container finally reach a retail store in the U.S., a substantial percentage may be found either piled on the bottom of the shipping container or hanging from one clip on the garment hanger. In either condition, labor must be applied to re-connect each garment to its associated hanger and, on occasion, additional operation such as pressing and/or cleaning must take place before the garment is ready to be placed on sale.

At the retail sales level, there is an increasing trend to employ fewer and fewer selling personnel; indeed, the trend has almost reached a self-service mode of selling, though a few sales personnel will always be required for providing style information and fitting. The result however is that the ratio of number of garments to each sales person is increasing. While this ratio does not, in itself, present problems at the retail sale level (due to some extent at least, to lowered expectations of sales clerk assistance by retail customers), the greater number of garments in a retail store department presents logistics problems. For example, at the end of a selling day it is the duty of the sales personnel to straighten up the racks so that a neat and tidy appearance is presented to the eyes of the customers as they enter the department on the next selling day. The greater the number of garments on the racks per each sales person, the greater will be the time required by each sales person to straighten the racks, a fact which is not appreciated by sales personnel at the end of their shift. Part of the straightening process involves pulling a garment, say a size 36 men's slacks, which has been inadvertently placed in the size 38 section of the rack and inserting it into the size 36 section. At the present time this task can be very time consuming and frustrating, especially when the rack space is limited as it always is for a period of time after a new season's inventory has been received. Specifically, the pulling out and pushing in motions of extracting a garment from one location on a rack and inserting the garment into another location on the rack can result in a garment on either the moved hanger or a racked hanger dropping its garment, or at least one side of the garment. This usually occurs when the clip of one hanger engages the clip of another hanger in a direction and with a force to cause one jaw of one of the interfering clips to open slightly, thereby releasing the gripping pressure on the garment and letting it drop under the impetus of its own weight. When such an event occurs the time to straighten a rack is increased, much to the annoyance of the sales personnel.

The problem of contact between two hangers with resultant spillage also occurs in the absence of a need to change the physical location of a garment along the axis of a suspending rack Specifically, during the course of a selling day adjacent garments will be pulled off the racks, or tilted upwardly for viewing, by customers, following which little or no effort is made to make sure that the viewed garment is returned to a level position. Indeed, at the end of a selling day, some hangers will be level, some will be tipped upwardly at their outer end (i.e.: the end closest to the customer), and some will be tipped upwardly at their inner end. The result is a very untidy appearance. To return the garments to a neat, organized condition sales clerks prefer to either simply press downwardly on the upturned hangers or, at most, wiggle adjacent off-tilted hangers back and forth slightly so as to enable the garments to come back to a neutral position in which they hang straight down. Unfortunately these simple hand motions can also result in dropped garments due, to a considerable extent, to unlocking forces being exerted on one jaw of the two jaws which form the clamp at the end of each hanger. A basic cause of this problem is the fact that in most hangers in use today the upper portion of the clip which extends upwardly above the jaw is exposed in the sense that it projects into space outside the boundaries, and particularly the width dimensions, of the hanger.

In addition to the problems encountered by the persons in the chain of commerce, there is the matter of customer convenience. When a customer shops in a retail store he or she often pulls out one or more garments (in addition to the one purchased) for the purpose of getting a better view and assessing the suitability of the garment for purchase. The customer wants to pull a garment off the rack and return it to the rack without difficulty and in the shortest possible time. If the garment, during either the pulling out or putting back operations strikes a racked garment in the clip area, one clip on the racked garment may open up and drop one end of the suspended garment. Indeed, the manipulation of the garment to be inserted may be such that one clip on the garment may open up and partially drop the garment while the garment is held by the customer.

And finally, one problem common to all hanger systems today is the need, and consequent expense, to provide four (usually) different sizes of hangers to accommodate the different sizes of garments.

SUMMARY OF THE INVENTION

This invention is a garment hanger which overcomes all of the above described problems in a single hanger. Specifically, the garment hanger of this invention is manufactured so that it will, (a) during transportation following assembly to a garment, (b) in the retail sales outlet, and (c) at all other times, grip a garment in such a fashion that the gripping pressure is not released and a garment dropped no matter how many shakes and bumps the hanger is subjected to during transportation or how quickly and carelessly garments are pulled from a rack and reinserted by customers, or pressed downwardly from above by the hands of a sales clerk passing over a series of hangers to bring the series into level alignment.

It is a further characteristic of this invention that all of the foregoing is accomplished in a hanger which has a very low profile; that is, a hanger in which the clip at each end of the generally horizontally oriented hanger body does not project above the upper surface of the hanger body.

Yet a further advantage of this invention is that all of the foregoing is accomplished in a hanger which reduces, in a multi-hanger size system, the number of sizes required by at least 50%.

BRIEF DESCRIPTION OF THE DRAWING

The invention is illustrated more or less diagrammatically in the accompanying drawing wherein:

FIG. 6 is a section view taken on line 6—6 of FIG. 4;

FIG. 7 is a perspective view of one half of the clip;

FIG. 8 is a side view of one half of the clip;

FIG. 9 is a front elevation of one half of the clip; and

FIG. 10 is a partial elevation of an alternative embodiment of the invention.

DESCRIPTION OF THE INVENTION

Figures 1, 2, 3:
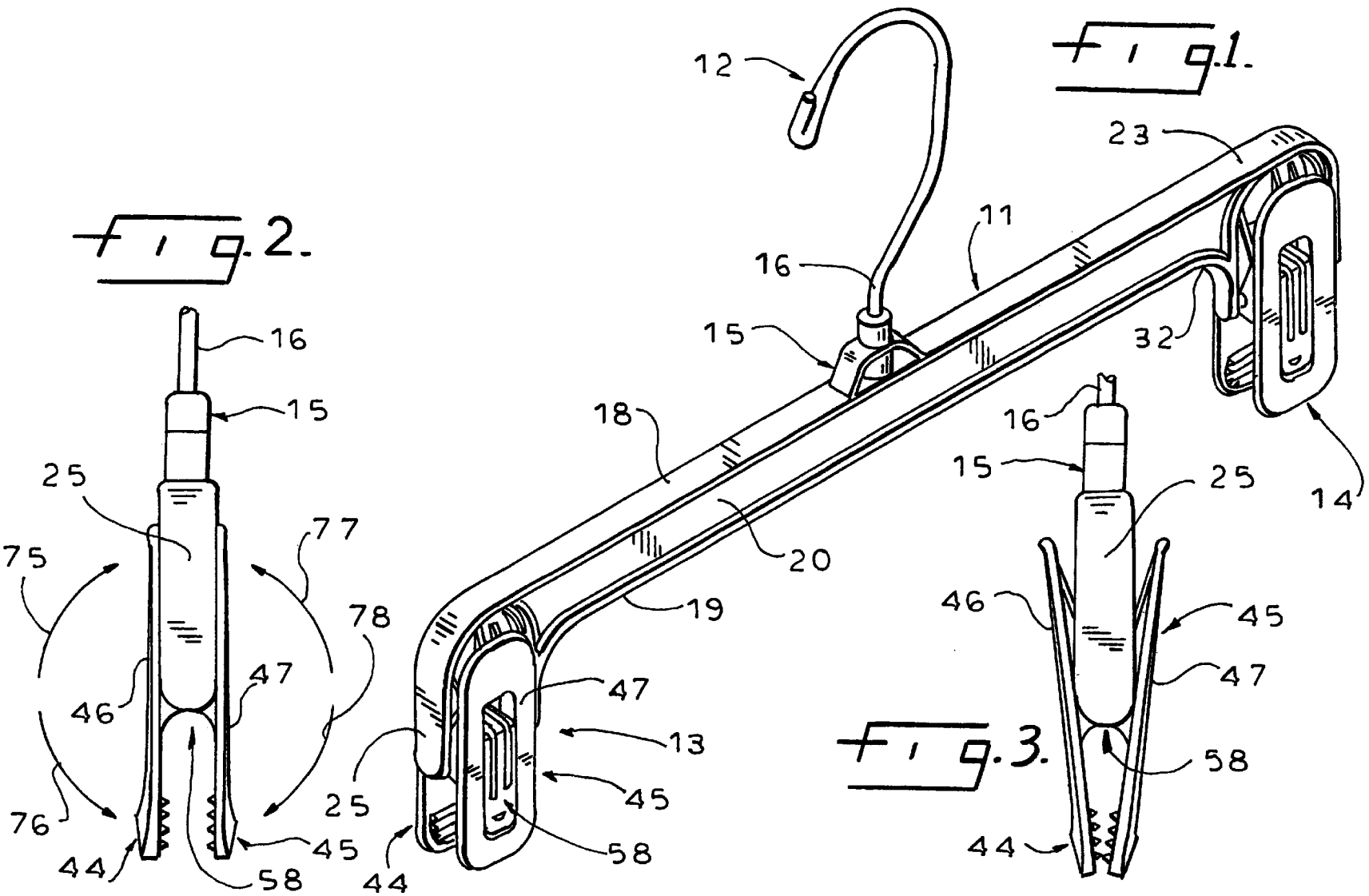
FIG. 1 is a perspective view of the garment hanger of the present invention.
FIG. 2 is a left end view of FIG. 1 with parts omitted for clarity and with the clip in a garment gripping, open position.
FIG. 3 is a similar left end view of FIG. 1 with the clip in a closed position.

Like reference numerals will be used to refer to like or similar parts from Figure to Figure in the following description of the invention.

The garment hanger of this invention is particularly well suited for assembly to a garment at a remote garment manufacturing location and thereafter retention of the garment on the hanger until the hanger is separated from the garment at the retail sales outlet by a retail sales clerk or by the purchaser at his home. In view of this highly desirable characteristic the hanger will sometimes hereinafter be referred to as a "ship-on" hanger.

The ship-on hanger of this invention is indicated generally at 10 in FIG. 1. The hanger includes a horizontal body, indicated generally at 11, hook means, indicated generally at 12, and left and right clamp assemblies, indicated generally at 13 and 14 respectively. A hook boss is indicated generally at 15, the hook boss being, in this instance, formed integrally with the body 11 to provide a base or socket for receiving the tail section 16 of the hook means 12. It should be understood that the hook means 12 can be either rigidly held in the hook boss 15 or be rotatable with respect thereto. Both systems are conventional in the art though the advantages of the invention may be more markedly appreciated when the hook means is non-rigidly received in the hook boss.

Body 11 is formed in the shape of an I-beam consisting of an upper flange 18, a lower flange 19, and a web 20. In this instance it will be noted, primarily from FIG. 6, that upper flange 18 is slightly wider than lower flange 19 and right housing wall 33, to be described hereinafter. The upper flange 18 extends the length of the body and then, at its far left end portion, blends into and forms the upper surface 22 of left clamp assembly 13. By the same token the far right end portion blends into and forms the upper surface 23 of right clamp assembly 14. The end portion of the upper flange 22 extends downwardly from the plane of the top of the upper half 18 to form an end shield 25 which extends about half way down the outer edge of clamp assembly 13.

Figures 4, 5:
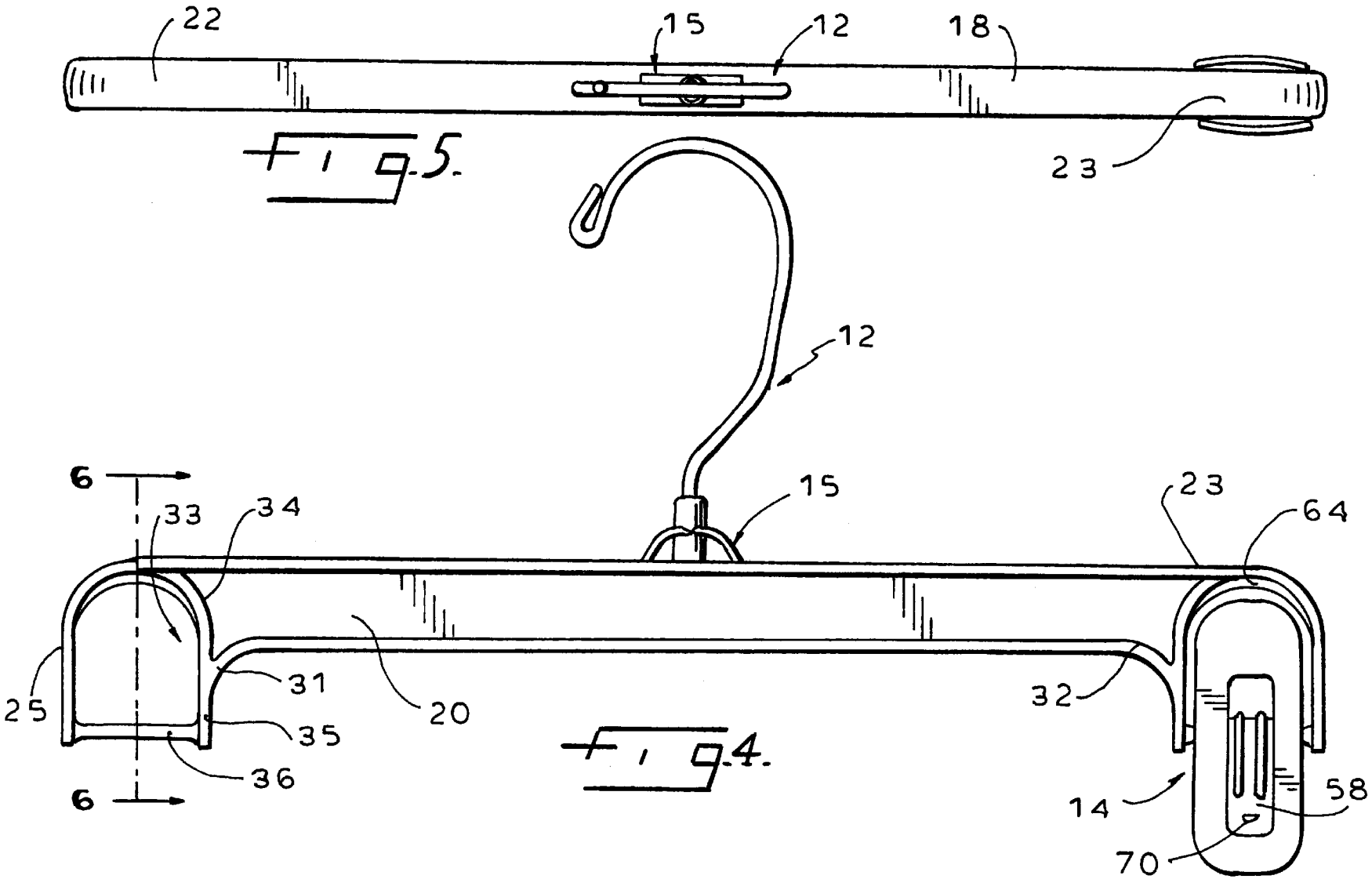
FIG. 4 is a front elevation with parts omitted for clarity of description.
FIG. 5 is a top plan with parts omitted for clarity.

The ends of lower flange 19 terminate at the clamp assemblies which are located at the ends of the body as will be noted from the, in this instance, rounded end portions 31 and 32 in FIG. 4. The housing of left clamp assembly 13 is formed from the end portion 22 of flange 18, the end shield 25, and the right housing wall, indicated generally at 33, which is comprised of an upper, curved portion 34, which extends from the underside of flange 18 to a junction with rounded end portion 31, and a vertical extension 35 whose lower end terminates at the same level as the lower end of end shield 25. A pivot bar 36 extends from the inside surface of end sheld 25 to the inside surface of extension 35. Since the clamp assemblies 13 and 14 are mirror images of one another only one need be described of which left clamp assembly 13 best illustrates the structure and advantages of this portion of the invention.

From FIGS. 1,2 and 3 it will be seen that left clamp assembly 13 includes a rear half indicated generally at 44 and a front half indicated generally at 45. The rear surface 46 of the rear half 44 is, in this instance, almost flush with the edge of the upper flange 18 and the end shield 25. By the same token, the front surface 47 of the front half 45 is, in this instance, almost flush with edge of the upper flange 18 and the end shield 25. It will be understood that, if desired, the edge of end shield 25 and the surfaces 46 and 47 may be co-extensive. It is only essential that the offset, if any, between the edges of end shield 25 and surfaces 46 and 47 not be so great that the associated rear half 44 and front half 45 of the clamp are so far exposed that when a similar adjacent hanger is pushed or pulled in the general direction of the length of flange 18, one clamp on hanger 10 can snag a similar clamp on the adjacent hanger and cause one or both clamps to open momentarily and drop that portion of a garment with which it is in gripping engagement.

The relation of the clamp assemblies 13 and 14 to the rigid body 11 is of key importance in this invention. Specifically, the clamp assemblies are bodily articulatable with respect to the rigid body 11. More specifically, the clamp assemblies 13 and 14 are bodily pivotable, while in clamping engagement with a garment, about a pivot axis carried by the rigid body 11.

Referring now particularly to FIGS. 1, 4, 7, 8 and 9 it will be seen that rear half 44 of left clamp assembly 13 has a series of generally elongated triangularly shaped ribs 50, 51, 52 and 53, see FIG. 7, which project inwardly from the inside surface 54 of rear clamp half 44. Each of ribs 50 and 53 has a seat, indicated at 50*a* and 53*a*, the seats being aligned with one another and shaped to receive pivot bar 36 in rotatable relationship. One half of a segmented collar, indicated generally at 55, is formed integrally with and extends between ribs 51 and 52, said half collar forming an elongated half seat for pivot bar 36 between seats 50*a* and 53*a*. Upper and lower shrouds 56 and 57 together with their common rear portion, not shown, form both a seat for horizontal pivot bar 36 and one half of a seat for a vertically located, inverted U-shaped spring 58, see FIGS. 1–4 and 10.

The right half 45 of left clamp assembly 13 has a plurality of elongated triangularly shaped ribs similar to ribs 50–53 of rear clamp half 44, two of which are indicated at 59 and 60. Rib 59 has a seat 59*a* analogous to seat 50*a* of rib 50, and the center ribs which project from the inside surface 61 of front half 45 have upper and lower shrouds 62 and 63 which nestle alongside shrouds 56 and 57 when the halves are in assembled relationship.

Thus, when rear half 44 and front half 45 are assembled to a pivot bar 36 and to one another by spring 58, the clamp assembly has a pivotable seat of near maximum width which provides maximum stability of the clamp assembly with respect to the rigid hanger body 11.

Rear half 44 has an opening 65 and front half 45 has a matching opening 66 for receiving spring 58. It will be noted that, in this construction, the edges of the U-shaped spring extend downwardly a much greater distance than do the legs of springs in conventional hangers. Indeed, as can be appreciated from FIGS. 1, 4 and 7–9, the lower end of each spring leg is at a near maximum lower level and, most importantly, directly opposite the garment gripping means, here teeth, 68 and 69. The upper edge of the retaining indent 70, see FIGS. 4 and 10, locks under the upper wall 71, see FIG. 9, of a retaining recess 72 at a location at which the inwardly directed gripping force of the U-shaped spring 58 can exert maximum clamping force on the rear half 44 and front half 45, and hence maximum gripping force on a garment retained in the clamp assembly. The garment gripping and garment empty conditions of the left clamp assembly 13 are shown in FIGS. 2 and 3 respectively.

FIG. 10 illustrates an alternative embodiment of the invention which makes possible a 50% reduction in the number of sizes of hangers which need be used to display garments of differing widths. At the present time garment manufacturers and retailers are often required to order and use four different sizes of hangers which sizes may be 9 inch, 10 inch, 11 inch and 12 inch, though other arrangements are possible. It will be understood that each size hanger requires a separate mold, or at least a special mold insert, and production and inventory problems are inherent in such a system. For example, should the garment hanger manufacturer be required to ship one million of each of four different length hangers, and one of the molds for one size go out of service for some reason, the entire shipment must be held up until the out of service size is repaired and brought into service. Such a delay ripples out into the garment indusry, first to the garment manufacturer and eventually to the retailer, to the great disadvantage and cost (in terms of lost or deferred sales) to all downstream users of the hanger. Thus it would be a great competitive and manufacturing advantage to have only one, or a minimum number, of sizes of hangers. If one machine in a group of machines producing only one or a small number of sizes goes out of service, the resultant delay is only a fraction of that encountered when one machine in a group of machines producing different sizes of hangers goes out of service. The embodiment of FIG. 10 meets this need. The pivot bar 74 has been extended at least one half inch, indicated at 73, beyond the edge of its associated clamp assembly. It will be understood that a one half inch extension on each of the two clamp assemblies on a single hanger will provide an additional inch of gripping width, and hence one hanger configuration may handle garments for which separate 9 inch and 10 inch hangers were formerly required, and a second hanger configuration may handle garments for which separate 11 inch and 12 inch hangers were formerly required. Thus, the hanger configurations have been reduced by 50% over the conventional four configurations.

Common to all embodiments however is the concept that the swinging movement of each clamp assembly about its associated pivot bar is in no way restricted by the balance of the hanger which is rigid. This articulation can be readily appreciated from the clearance 64 between the underside of the right end portion of the flange 18 and the top edges of the rear and front clamp halves as seen in FIGS. 1, 4 and 10, and diagrammatically represented in FIG. 2 by the arrows 75, 76, 77 and 78.

The end shields 25 are particularly effective when hung garments are placed back onto a rack. Customers who have extracted a hung garment from a rack for observation are often quite careless in returning the garment which has just been observed back onto the rack. At the present time retail sales personnel are faced with the frequent task of picking up garments which have been completely or partially knocked off their hanger by careless and hurried handling by potential buyers. Since end shields 25 cover the outermost edges of the front halves of their associated clamp assemblies, there is no opportunity to snag a clamp on a racked garment and cause it to open and drop its garment.

It should also be noted that the illustrated and described construction provides maximum rack density; the greater the number of garments which can be displayed per lineal foot of rack the greater will be the sales of garments. By ensuring that (a) the edge of the end shields 25, and (b) the outside surface of the outer half of each clamp assembly lies in the same plane, or almost the same plane, when the hanger supports a garment, only the absolute minimum of rack length is required to display a garment. Indeed, in trials to date, a rack density of 12% greater than conventional hangers has been achieved. It should also be noted that by reason of the placement of the reinforcing ribs 50–53 and 59, 60 in opposing positions with respect to one another as a result of the need to provide the flat outside surfaces 46, 47 on the outside surfaces of the clamp halves, up to approximately a 20% thinner construction results.

It should also be again noted that the greater than usual drop of the clamp assemblies from the hanger body enables a spring clip of a much longer vertical dimension to be used than was heretofore customary. With the illustrated construction the spring is able to reach down all the way to the tooth clamping areas of the inner portions of the jaws, and hence maximum spring derived clamping force is obtained. As a result creep of the clip during shipping of garments on hangers is eliminated and no garments are to be found lying in a crumpled heap at the bottom of the shipping container when it is opened at its destination.

Although a specific example, and modifications thereof, have been illustrated and described, it will at once be apparent to those skilled in the art that modifications to the basic inventive concept may be made within the spirit and scope of the invention. Hence the scope of the invention should only be limited only by the scope of the hereafter appended claims when interpreted in light of the relevant prior art, and not by the foregoing exemplary description.

We claim:

1. An articulatable high rack density ship-on garment hanger having a hanger body having front and back surfaces, clamp means on the hanger body for holding a garment, and suspending means for suspending the hanger body, clamp means and a garment from a support location, the improvement comprising shields formed on said hanger body which are immovable for preventing unintended opening of the clamp means during shipment and display of a garment held on said hanger;

articulation means for articulating the clamp means with respect to the balance of the garment hanger in response to forces imposed on the hanger body and clamp means which, in the absence thereof, would separate the clamp means from the garment clamped therein; and said shields extending from the front and back surfaces of said hanger body.

2. The articulatable high rack density ship-on garment hanger of claim 1 further characterized in that said means for preventing unintended opening of the clamp means includes means on the hanger body for protecting the edges of the clamp means from contact with dislodgement forces, and swiveling means associated with each of the clamp means and the adjacent portions of the hanger body for articulating the clamp means with respect to the hanger body.

3. The articulatable high rack density ship-on garment hanger of claim 2 further characterized in that said clamp opening prevention means is a shielding means which extends outwardly over the clamp means a distance at least substantially equal to the distance that the clamp means projects outwardly from the hanger body when said clamp means holds a garment, and downwardly a distance sufficient to shield the clamp means through approximately the mid-portion of the clamp means.

4. The articulatable high rack density ship-on garment hanger of claim 3 further characterized in that the clamp means includes two clamp halves, the outside face of each of said clamp halves being substantially co-extensive with the adjacent outside faces of the hanger body, when the clamp halves are in a garment gripping condition.

5. The high rack density ship-on garment hanger of claim 2 further characterized in that said swiveling means is a pivot bar carried on the hanger body and pivot bar gripping means carried by the clamp means.

6. The high rack density ship-on garment hanger of claim 5 further characterized in that the pivot bar is integral with the hanger body and the clamp means swivels about the pivot bar.

7. The articulatable high rack density ship-on garment hanger of claim 1 further characterized in that the clamp means do not project above the hanger body.

8. The articulatable high rack density ship-on garment hanger of claim 7 further characterized in that said means for preventing unintended opening of the clamp means includes means on the hanger body for protecting the edges of the clamp means from contact with dislodgement forces, and swiveling means associated with each of the clamp means and the adjacent portions of the hanger body for articulating the clamp means with respect to the hanger body.

9. The articulatable high rack density ship-on garment hanger of claim 8 further characterized in that said clamp opening prevention means is a shielding means which extends outwardly over the clamp means a distance at least substantially equal to the distance that the clamp means project outwardly from the hanger body when said clamp means holds a garment, and downwardly a distance sufficient to shield the clamp means through approximately the mid-portion of the clamp means.

10. The articulatable high rack density ship-on garment hanger of claim 9 the clamp means further comprises two clamp halves, said clamp halves having a plurality of ribs so that the outside face of each of said clamp halves is substantially co-extensive with the adjacent outside faces of the hanger body.

11. The articulatable high rack density ship-on hanger of claim 10 further characterized in that said swiveling means is a pivot bar carried on the hanger body and pivot bar gripping means carried by the clamp means.

12. The articulatable high rack density ship-on hanger of claim 11 further characterized in that the pivot bar is integral with the hanger body and the clamp means swivels about the pivot bar.

13. The articulatable high rack density ship on hanger of claim 12 further characterized in that the length of the pivot bar is longer than the width of the pivot bar receiving structure on the clamp halves.

* * * * *